US010173183B2

(12) United States Patent
Lowe, Jr.

(10) Patent No.: US 10,173,183 B2
(45) Date of Patent: Jan. 8, 2019

(54) DIAPHRAGM PUMP WITH IMPROVED TANK RECIRCULATION

(71) Applicant: Flowserve Management Company, Irving, TX (US)

(72) Inventor: Sidney Edward Lowe, Jr., Moyock, NC (US)

(73) Assignee: Flowserve Management Company, Irving, TX (US)

( * ) Notice: Subject to any disclaimer, the term of this patent is extended or adjusted under 35 U.S.C. 154(b) by 567 days.

(21) Appl. No.: 14/848,407

(22) Filed: Sep. 9, 2015

(65) Prior Publication Data

US 2016/0074818 A1 Mar. 17, 2016

Related U.S. Application Data

(60) Provisional application No. 62/048,886, filed on Sep. 11, 2014.

(51) Int. Cl.
*B01F 5/12* (2006.01)
*F04B 43/02* (2006.01)
(Continued)

(52) U.S. Cl.
CPC ..... *B01F 5/12* (2013.01); *B01F 5/0212* (2013.01); *B01F 5/106* (2013.01);
(Continued)

(58) Field of Classification Search
CPC ..... B01F 5/12
See application file for complete search history.

(56) References Cited

U.S. PATENT DOCUMENTS 3,674,686 A * 7/1972 Brimmer ..... B01D 37/02 210/685
4,086,036 A 4/1978 Hagen
(Continued)

FOREIGN PATENT DOCUMENTS

GB 1 405 264 A 9/1975
TW 483 123 8/2014

OTHER PUBLICATIONS

International Search Report pertaining to Application No. PCT/US2015/049428 with a filing date of Sep. 10, 2015.

*Primary Examiner* — Abbas Rashid
(74) *Attorney, Agent, or Firm* — Dinsmore & Shohl, LLP

(57) ABSTRACT

An assembly made up of a pump, a container and an augmented fluid-recirculating system for increased working fluid agitation, and a method of agitating a liquid within a container—as well as dispensing such a liquid from the container—where the liquid has been subjected to such augmented agitation prior to such dispensing. The pump cooperates with the fluid-recirculating system that includes an eductor such that the liquid resident within the container may be recirculated in a manner to promote its own agitation. In addition, air or a related fluid may be passively introduced upstream of the pump such that it also may pass through the eductor. In one form, the assembly defines a closed-loop system such that the air or other gas already present in the container may be introduced selectively, while in another form, the assembly defines an open-loop system that retrieves air from a local external environment. In either case, the introduction of such air or related gas may be selective, thereby permitting an operator to dictate if such air should be recirculated. In addition, the use of a diaphragm
(Continued)

pump helps avoid damage to the portions of the pump that are exposed to a mixed phase fluid flow made up of the air and recirculated liquid.

13 Claims, 8 Drawing Sheets

(51) Int. Cl.
*B01F 5/02* (2006.01)
*B01F 5/10* (2006.01)
*B01F 13/02* (2006.01)
*B01F 3/00* (2006.01)

(52) U.S. Cl.
CPC ..... *B01F 13/0222* (2013.01); *B01F 13/0255* (2013.01); *F04B 43/02* (2013.01); *B01F 2003/0035* (2013.01)

(56) References Cited

U.S. PATENT DOCUMENTS 4,610,605 A 9/1986 Hartley
4,768,714 A * 9/1988 Luchsinger ..... A01M 7/0017 222/175
4,864,918 A 9/1989 Martin
5,078,965 A * 1/1992 Pearson ..... A61L 11/00 210/173
5,137,694 A * 8/1992 Copeland ..... A47L 15/4436 134/56 D
5,217,797 A 6/1993 Knox et al.
5,298,386 A * 3/1994 Czekai ..... G03C 7/388 430/377
5,353,689 A 10/1994 Bolt
5,476,367 A 12/1995 Zimmermann et al.
5,564,599 A * 10/1996 Barber ..... B65D 11/1853 206/600
5,615,597 A 4/1997 Schoenmeyr
5,626,464 A 5/1997 Schoenmeyr et al.
5,632,607 A 5/1997 Popescu et al.
5,642,991 A 7/1997 Singleterry
5,699,717 A 12/1997 Riedlinger
5,706,715 A 1/1998 Schoenmeyr
5,771,000 A 6/1998 Matsumoto et al.
5,791,882 A 8/1998 Stucker et al.
5,800,136 A 9/1998 Kurth et al.
5,816,133 A 10/1998 Schoenmeyr
6,048,183 A 4/2000 Meza
6,089,838 A 7/2000 Schoenmeyr et al.
6,092,998 A 7/2000 Dexter et al.
6,299,414 B1 10/2001 Schoenmeyr
6,361,201 B1 * 3/2002 Russell ..... A61M 1/1656 366/136
6,554,587 B2 4/2003 Paolini et al.
6,623,245 B2 9/2003 Meza et al.
6,840,745 B1 1/2005 Macauley et al.
6,892,624 B2 5/2005 Schoenmeyr et al.
7,013,793 B2 3/2006 Dang
7,037,086 B2 5/2006 Irvine
7,059,759 B2 * 6/2006 Hummer ..... B01F 5/0218 366/137
7,083,392 B2 8/2006 Meza et al.
7,424,847 B2 9/2008 Hart
7,451,687 B2 11/2008 Lynn et al.
7,726,870 B1 6/2010 Lott
7,762,791 B2 7/2010 Cai et al.
7,878,766 B2 2/2011 Meza et al.
7,887,304 B2 2/2011 Cai et al.
8,070,458 B2 12/2011 Meza
8,276,617 B2 10/2012 Cai et al.
9,114,367 B1 * 8/2015 Thomas ..... B01F 5/0426
9,682,347 B2 * 6/2017 Patel ..... B01F 1/0038
2008/0074944 A1 3/2008 Blechschmitt et al.
2010/0025338 A1 * 2/2010 Hayas ..... C02F 1/688 210/749
2015/0299466 A1 * 10/2015 Qiu ..... C08L 91/06 106/498

* cited by examiner

DIAPHRAGM PUMP WITH IMPROVED TANK RECIRCULATION

This application claims priority to U.S. Provisional Application 62/048,886, filed Sep. 11, 2014.

This invention relates to a pump and assemblies thereof that include additional features for increased agitation of a fluid within a container, and more particularly to a diaphragm pump that uses a fluid-recirculating system with an eductor and passive air injection to achieve such increased agitation.

BACKGROUND OF THE INVENTION

Large containers, tanks or related vessels (often sized to hold between about 120 to 330 gallons of working fluid (i.e., product) material) are used to store and transport chemicals such as fertilizers, insecticides and herbicides that are used in agricultural and related industrial purposes. In one form, these containers are purpose-built from a generally one-piece plastic mold of a particular shape and dimension to enable convenient stacking for storage, as well as possessive of upstanding projections to provide protective placement of a crop sprayer, pump or other suitable liquid-dispensing apparatus; such containers are often colloquially referred to as mini bulk tanks. Another form is known as an intermediate bulk container (IBC), where a generally rectangular-shaped plastic material is housed within a complementary-shaped metal skeleton frame to provide a relatively rigid, structural container. Regardless of the configuration, the chemicals contained in such vessels are often concentrated and viscous, and are prone to stratification during storage, including the formation of a serum-like upper layer. In such circumstances, it is advantageous to agitate the contents prior to dispensing to ensure even distribution of the active materials within the working fluid. Furthermore, dedicated pumps may be included to help promote the aforementioned agitation, while an integral-like connection between the pump and container is established to further comply with sealing, anti-tampering and related fluid isolation requirements. Because the pumps are often placed at or near the place of fluid ingress or egress, environmental regulations may additionally require that the pump-to-container interface be sealed with tamper-resistant devices.

While conventional pumps return fluid back into the container, their ability to achieve thorough content agitation (and concomitant mixing) is limited; this is especially so for fluids such as those mentioned above that exhibit significant viscous- or serum-like upper layer formation or related stratification. Thus, in circumstances where thorough mixing is required, a user would have to defeat any tamper-resistant features by breaking the seal in order to gain access to the inside of the container as a way to install a portable mixer. Such activities could present a cleanup and disposal problem for any of the residual chemicals on the pump dip tube, mixer blade and other installed components, as well as expose personnel to potentially harmful fluids within the container. While other ways to enhance agitation, such as the introduction of compressed air or related fluid, are effective, they tend to add significant overall system cost and complexity in the form of additional pumps, valves and piping. Furthermore, there are limits on how such agitating fluids may be introduced into a pump and tank assembly, as many pumps may suffer cavitation-related damage (or have their effectiveness significantly curtailed) by having to process fluids where both gaseous and liquid phases may be present.

Moreover, there are some contained fluids that suffer adverse reactions when exposed to air or related agitants.

Diaphragm pumps rely upon the cammed, wobbling or nutating motion of a pistoned plate-like member for converting the rotary movement of an accompanying motor into reciprocating pumping movement imparted to a fluid that has been introduced into a pumping chamber that is partially defined by the diaphragm. In one typical form, the diaphragm is made from a flexible material that defines multiple individual pumping chambers arranged circumferentially such that the suction and discharge of the fluid being pumped correspond to axial and tangential flow into and out of the pump. The present inventor has recognized that such pumps are particularly advantageous for use in conjunction with IBCs and mini bulk tanks, particularly those used in for agricultural and chemical process shipping, storage and dispensing. The present inventor particularly recognized that the diaphragm pump is well-suited for use on a viscous fluid environment and is relatively impervious to cavitation, making it a good way to provide agitation and related mixing to stratification-prone contents within such IBCs or purpose-built containers. Nevertheless, there remains a need to provide enhanced agitation and related mixing in such closed containers where stratification-prone liquids are stored.

SUMMARY OF THE INVENTION

It is with this recognition that the present invention is disclosed herein. According to an aspect of the present invention, an assembly for use in a liquid container such that enhanced mixing of the fluid therein is disclosed. The system includes a pump and fluid-recirculating system, where the latter includes conduit with an eductor that cooperates to help magnify the amount of the remainder of the stored fluid within the container that can be circulated, thereby promoting the more thorough mixing of the resident fluid. In addition, self-contained (i.e., in situ) air that is also resident within the container may be drawn into the fluid-recirculating system to provide more mixing through air bubble formation and dispersal at or near the bottom of the tank or container. By liberating the formed air bubbles near the bottom of the tank as the mixed-phase fluid is passed through the eductor, they gravitate upward to cause greater mixing at or near the upper surface of the resident liquid. This combination of eductor action and bubble formation is particularly beneficial in situations where the fluid may have settled during a prolonged storage such that gravity-based striations have set in. The eductor is preferably situated at one terminal end of the conduit, while the portion of the fluid to be recirculated is in fluid communication another terminal end. More preferably, the terminal ends are spaced apart from one another as a way to promote an even more thorough mixing. As will be understood by those skilled in the art, the eductor works on the Venturi effect according to Bernoulli's thereom where a negative pressure gradient is created around the eductor by the fluid being conveyed through the fluid-recirculating system; ports within the eductor permit the recirculated fluid to act upon adjacent static fluid within the container, increasing the volumetric flow by up to fourfold.

In a preferred form, the assembly is used as part of a closed (or closed-loop) system; in this way, the operation is such that resident air within the top of the container may be circulated to enhance the agitation beyond that provided by the eductor and recirculating working fluid alone. In particular, because such air is taken from the limited volume within the tank that is immediately underneath the lid and introduced upstream of the pump such that it—along with the portion of the working fluid within the conduit—can be recirculated, no contaminants are introduced to the resident liquid. By including suitable valving, in other situations where the fluid within the container can adversely react with air or bubbles, the closed system is still advantageous in that such additional air circulation may be disabled by such valving.

In an alternate form, supplemental fluid (such as local environment (i.e., ex situ) air or the like) may be introduced in a manner generally similar to that of the resident air from the closed-loop system above; in one for, such ex situ air may be a supplement to the in situ air, while in another, it may be used in place of the in situ air. Regardless of whether the ex situ air is the sole or supplemental source, it gives the system or assembly a selectively-engageable open-loop component. Such an approach may be useful when used in conjunction with a speed-regulating muffler in that it may provide a pre-set amount of air flow to the recirculation line. In such open-loop configurations, the tank would need to be vented while air is being added. Likewise, the introduction of air may be useful during product dispensing as a way to keep the container from collapsing. Significantly, such supplemental fluid may be introduced into the fluid-recirculating system without having to be actively pressurized in a manner generally similar to the resident air discussed above, as it is being introduced to the pump inlet.

According to another aspect of the present invention, a fluid-dispensing assembly is disclosed. In addition to the pump and fluid-recirculating system as discussed above in conjunction with the first aspect, the assembly includes a tank or related container to house a quantity of fluid therein. Such fluid may be predominantly made up of a liquid that occupies the majority of the tank, while a small amount of air or related gas may be situated in the topmost portion of the tank. As with the other aspect, introduction of the air or gas into the fluid-recirculating system may be made to occur without having to be actively pressurized in that such air or gas is drawn into the pump by the latter's suction action.

According to yet another aspect of the present invention, a method of agitating a fluid within a container is disclosed. The method includes providing a container with a pump disposed and a fluid-recirculating system. The pump, container and fluid-recirculating system cooperate such that when a liquid is placed within the container, first and second flowpaths defined within the fluid-recirculating system cooperate to convey at least some of the liquid through an eductor that is fluidly disposed in the first flowpath; in this way, the resident liquid draws in (such as due to the lower pressure in the local region that adjacent the eductor) to cause a leveraged, multiplier effect, which in turn increases the output of the liquid from the eductor. The second flowpath is fluidly cooperative with the first flowpath such that air is combined with the liquid; in this way, both air and liquid are routed through the eductor so that when dispensed from the terminal end adjacent the eductor, the previously-entrained air forms bubbles that are dispersed within the resident liquid and conveyed upward through such liquid until the interact with the upper liquid layer to provide additional mixing action. In a preferred form, the assembly includes using a diaphragm pump.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION

Figure 1:
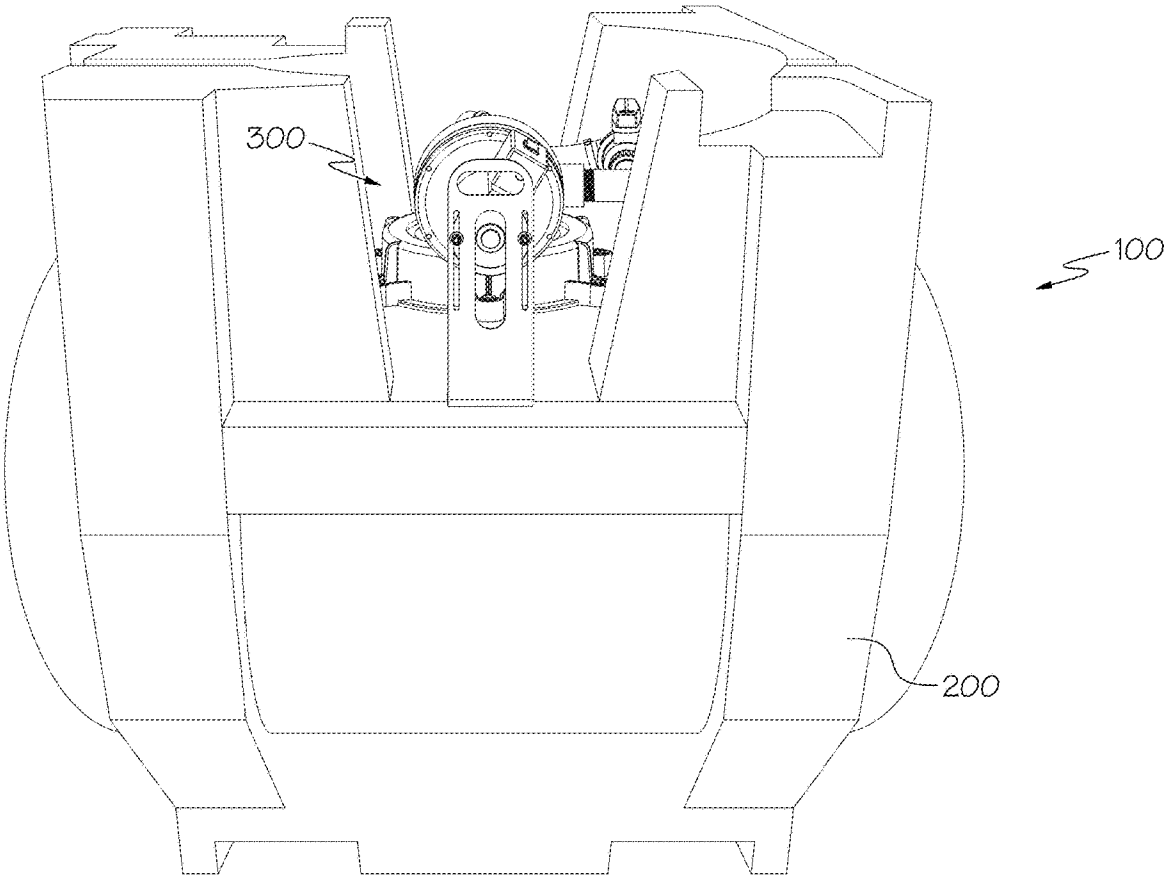
FIG. 1 shows an elevation view of a closed-loop embodiment of the container system that includes a purpose-built fluid container with a diaphragm pump and fluid-recirculating conduit according to one aspect of the present invention.
Figure 2:
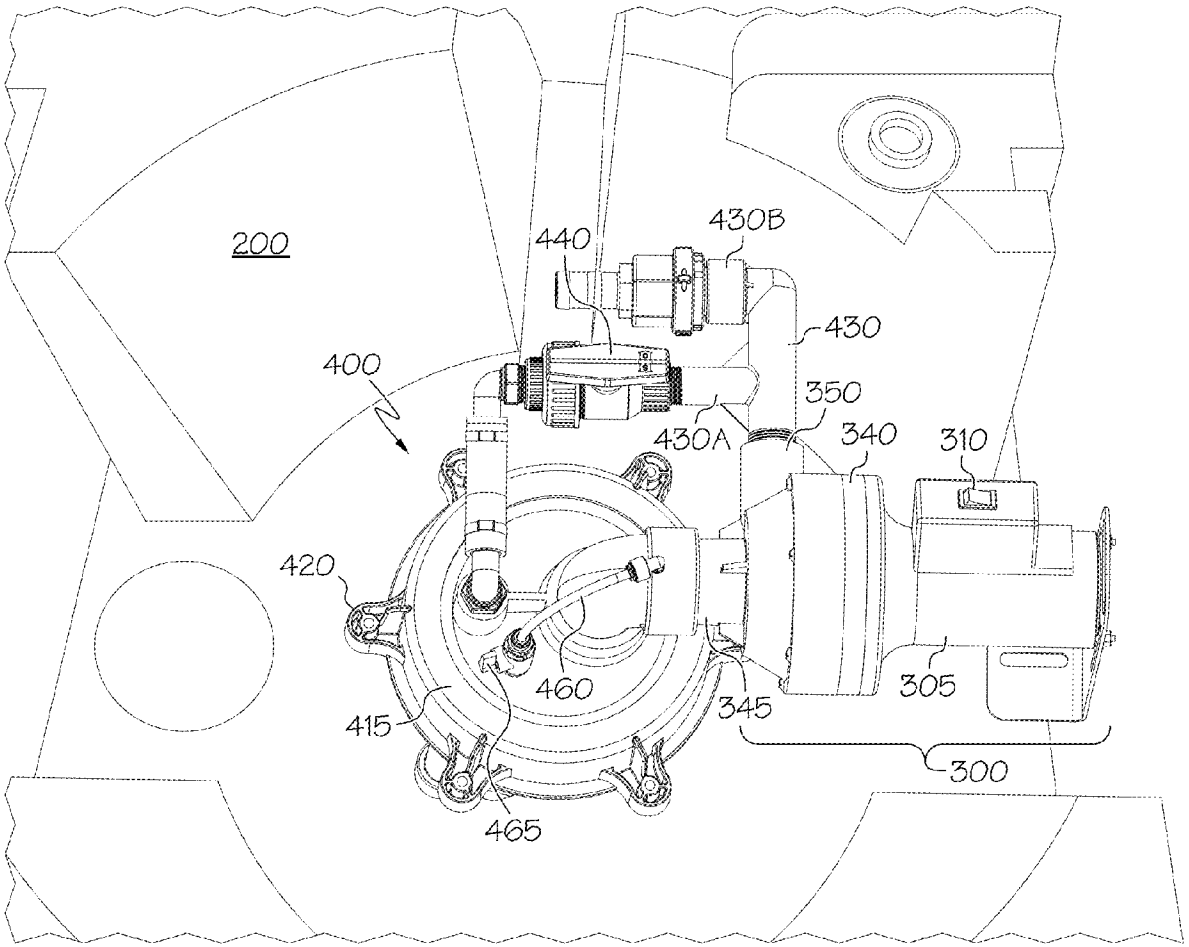
FIG. 2 shows a top view of the assembly of FIG. 1, highlighting portions of the fluid-recirculating conduit and pump.
Figure 3:
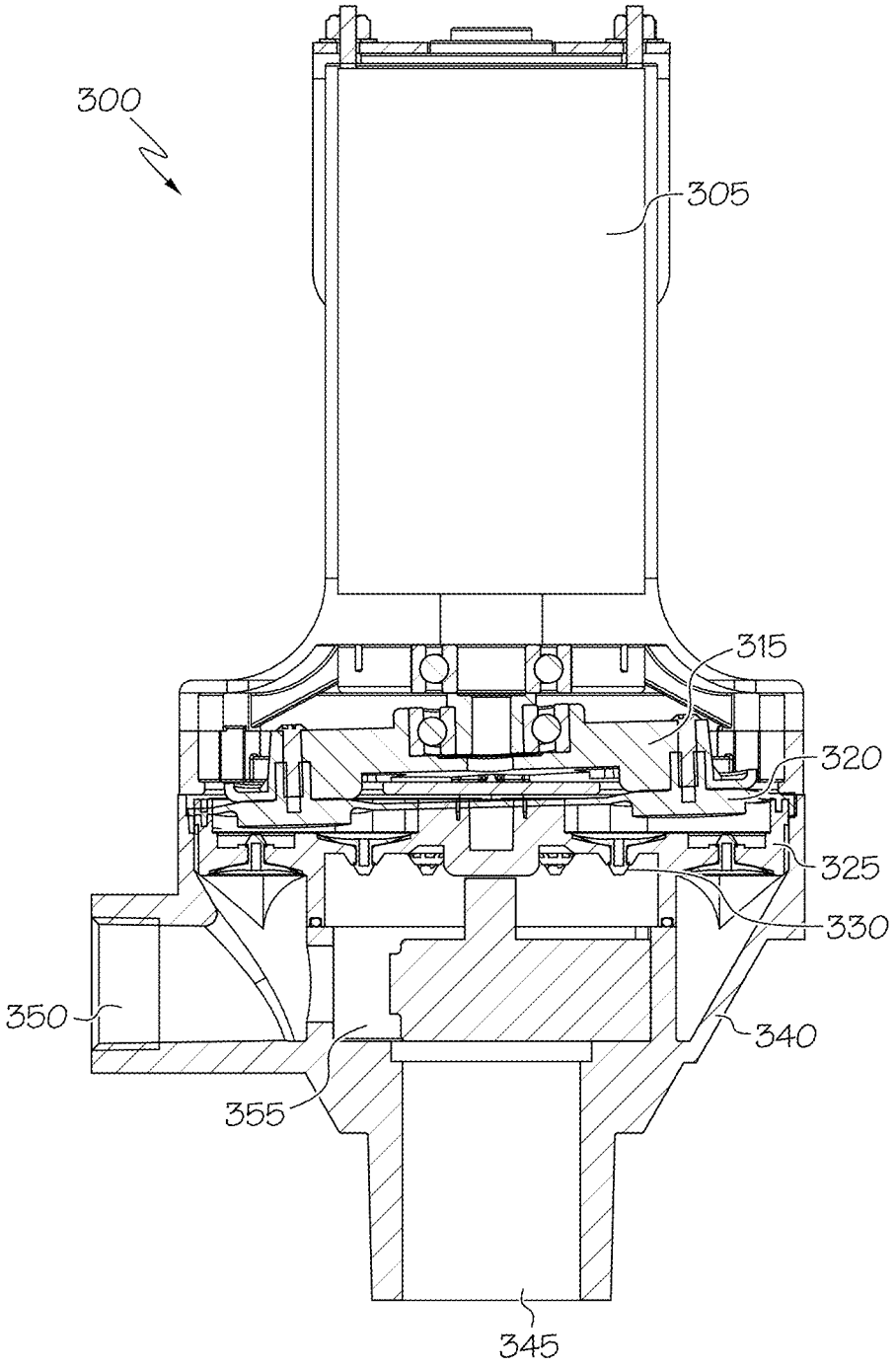
FIG. 3 shows a cutaway view of a diaphragm pump of FIGS. 1 and 2.

Referring initially to FIGS. 1 through 5, an assembly 100 according to a first aspect of the present invention includes a vessel or related container in the form of a purpose-built tank 200, diaphragm pump 300 and fluid-recirculating system 400. In one configuration, the tank 200 is of one-piece design, and can be manufactured by methods known in the art, such as blow molding, rotational molding or the like. Pump 300 is preferably in the form of a transfer pump. In the present context, a pump primarily used as a transfer pump is one that dispenses typically concentrated liquid mixtures (for example, herbicides) to another vessel that acts as the end-use for the liquid that may become diluted once placed in the end-use vessel. Pump 300 includes a motor 305 with an on/off switch 310 with power cables 312, wobble plate 315, a diaphragm 320, valve plate 325 with valves 330 (collectively referred to as a valve assembly) and pump housing 340 made up of a fluid suction (i.e., inlet) 345, discharge (i.e., output) 350 and optional bypass 355. The arrows that are shown with particularity in FIG. 4 highlight the general flowpath of a chemical or other fluid contained within tank 200 that is introduced to and operated upon by pump 300. Collectively, the wobble plate 315, diaphragm 320, valve plate 325 with valves 330 and the ancillary housing 340, bearings, shafts and related structure make up the pressurizing device that is segmented into numerous pumping chambers (presently depicted as a six-chamber design). The number and size of such chambers may be varied, depending on the particular pump configuration, and that all such variants are deemed to be within the scope of the present invention.

Referring with particularity to FIGS. 2 through 5, additional components of the pump 300 and fluid-recirculating system 400 are shown as mounted on a customer's purpose-built tank 200 as part of a closed-loop system. In particular, the fluid suction of the pump inlet 345 and fluid discharge of the pump output 350 are coupled via conduit in the recirculation system 400 that includes respectively an inlet dip tube 405 and outlet down pipe 410 (both shown with particularity in FIG. 4) that are secured to a cap or lid 415 through flanged or threaded apertures 417 (shown with particularity in FIG. 5) or related openings formed therein. In this way, all recirculating fluid ingress and egress takes place through the lid 415 that is securely mounted through the sole opening formed in the top of the tank 200, thereby contributing to the closed nature of the assembly 100. Thus, within the present context, such a closed system, assembly or related structure is one where only in situ materials that are resident in the tank 200 are permitted to be introduced to the fluid-recirculating system 400. In such configurations, mufflers, apertures, filters or related avenues for the introduction of ex situ supplemental air or related fluid (such as discussed in more detail below) would not be permitted (although selective venting to ensure pressure balances between the inside and outside of tank 200 are permitted).

Peripheral tabs 420 are integrally-formed as part of lid 415 and can accept suitably-configured bolts, rivets or other fasteners with conventional attachment schemes to provide tamper-resistant coupling between the lid 415 and tank 200. As can be seen, both the inclusion of a radially-spaced relationship between the dip tube 405 and the down pipe 410 in lid 415 as well as the placement of their respective inlet and discharge openings from one another at their respective ends when placed at or near the bottom of the tank 200 helps to ensure adequate bifurcation of the suction and pressurized fluid to further promote agitation and thorough mixing of the static, resident fluid. In one preferred form, the region of the tank 200 at or near the bottom is understood to include the portion of the container where a first layer of a stratified liquid may reside. In addition to the dip tube 405 and down pipe 410, conduit that is used to convey the fluid through the fluid-recirculating system 400 includes various piping 430 that is coupled to the pump outlet 350 and may include bifurcating parallel paths or piping 430A, 430B that correspond to a recirculating flowpath and a dispensing or transferring flowpath respectively. Thus, while both define fluid-conveying conduit, it will be understood that the portion corresponding to path 430B does not form a part of the fluid-recirculating system in that fluid passing therethrough is preferably then routed to a dispensing head or related discharge for uses consistent with the fluid's purpose. In addition, one or more valves 440 may be placed somewhere along piping 430 to facilitate the selective preferential routing through one or the other of such paths.

Additional details associated with pump 300 may be found in U.S. patent application Ser. No. 14/332,627, filed Jul. 16, 2014 and entitled DIAPHRAGM PUMP, as well as U.S. patent application Ser. No. 14/467,207, filed Aug. 25, 2014 and entitled VALVE AND VALVE SEAT FOR A DIAPHRAGM PUMP, both owned by the Assignee of the present invention and incorporated herein by reference in their entirety. The present inventor has determined that the diaphragm pump is particularly well-configured to be used as part of the assembly when the fluid being recirculated exhibits significant mixed-phase properties; in addition to the aforementioned fertilizers, insecticides and herbicides, such fluids may include paints, coatings (such as wood treatment coatings), dyes, pigments, diesel exhaust treatment fluid (such as urea) and related industrial chemicals that have concentrated, viscous attributes, including one or more stratification-prone serum-like upper layers. More particularly, the cavitation or related damage that may occur through the introduction of a mixed-phase fluid (which may become further mixed via introduction of air from either within the tank 200 in a closed-loop system) or from the ambient external environment (in an open-loop system)) into impeller-based pumps is avoided with diaphragm pumps.

One important attribute of the fluid-recirculating system 400 is that the down pipe 405 includes an eductor 450 at its discharge end that can be used to significantly improve the amount of agitation that is imparted to the fluid within tank 200. In one form, eductor 450 may act as a multiplier to leverage up to four times the volume of recirculated working fluid by its venturi-like operation. The terminal ends of the dip tube 405 and outlet down pipe 410 define openings to permit the fluid's respective intake from and output to the tank 200. In this way, the portions of conduit (which is presently shown as tubing, piping or the like) with first and second terminal ends are spaced apart from one another so that the conduit includes the eductor 450 adjacent the first terminal end such that upon operation of the pump 300 and receipt of fluid therein from the second terminal end that is adjacent the dip tube 405, fluid passing through the fluid-recirculating system 400 causes a negative pressure gradient to form in the eductor 450 in order to permit adjacent fluid that is resident within the tank 200 to be drawn into the first terminal end for subsequent dispersal within the container. As shown with particularity in FIG. 4, an elbow 452 may be included to aim the output from the eductor 450 at an oblique angle relative to the bottom of the tank 200 in order to improve batch turnover. In one preferred form, such elbows may form a forty-five degree angle. By aiming the eductor 450 at the tank 200 bottom, agitation of the lowest of the stratified layers is enhanced, as is the tendency of the fluid near the bottom of the tank 200 to exhibit an upward rolling movement as it is forced through the rounded corners and up the sidewalls.

Figure 5:
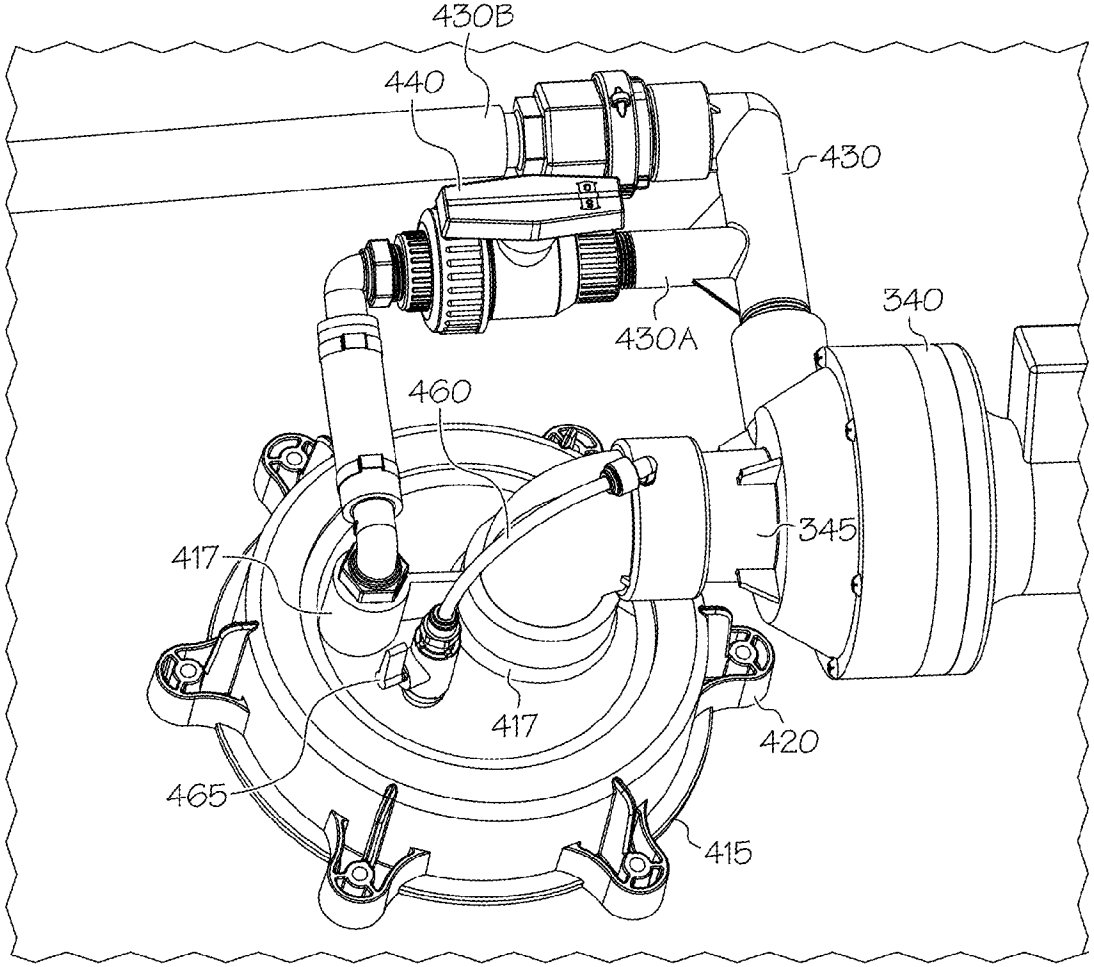
FIG. 5 shows a detail view of the connectivity between the lid and conduit of the fluid-recirculating system to the pump for the system of FIG. 1.

Furthermore, as shown with particularity in FIG. 5, another important attribute is that air resident within the closed tank 200 may be recirculated to further enhance agitation and mixing. Such recirculation is done via air line 460 and accompanying valve 465 where air in the top interstitial volume inside the tank 200 is drawn via suction into the pump inlet 345 such that upon pressurization is delivered via piping 430A to the down pipe 410 and eductor 450.

The present inventor has found that the combined use of the eductor 450 and the air line 460 significantly increases the ability of the pump 300 and fluid-recirculating system 400 to thoroughly mix the fluid. Correspondingly, the fluid-recirculating system 400 includes two flowpaths, and while both share significant conduit (such as piping 430, down pipe 410 and eductor 450), each is primarily responsible for the introduction of its respective fluid into the overall fluid-recirculating system 400. Thus within the present context, the first flowpath is best represented (in addition to the down pipe 410 and eductor 450) by the recirculating part 430A of piping 430 in that it operates predominantly on the liquid contained within tank 200, while the second flowpath is best represented by air line 460 in that it operates predominantly on the air that is contained in the volume above the liquid. As will be understood by reference to the remainder of the disclosure herein, at least portions of the two flowpaths overlap in the region of the fluid-recirculating system 400 that is fluidly between the pump inlet 345 and the terminal point at the end of eductor 450 such that both liquid and air are being conveyed together as a mixed-phase fluid.

Whether recirculating working fluid or mixing the working fluid with the agitating fluid, the eductor 450 operates via passive means that takes advantage of the venturi effect (a particular case of Bernoulli's principle) where ambient-pressure fluid is drawn in and mixed via suction into the low static pressure region of a convergent-divergent nozzle by a high-velocity jet of the working fluid that passes through the eductor 450 throat. Such operation allows the recirculated working fluid (as well as the intermixed air from within the tank 200) to be ejected to a region at or near the bottom of tank 200 as a way to stir up the working fluid stored therein. In this way, it is preferable to having to separately pressurize one or both of the leveraged working fluid and agitating fluid into the down pipe 410 in that it avoids the extra system complexity associated with such compressing equipment. With particular regard to the agitating fluid, the distinction between its passive and active introduction is not based on whether a pump (such as pump 300) is employed to convey a working fluid from storage within a container to a remote destination, but rather on whether additional powered means (such as through another compressor, pump or related device) are needed to impart higher pressures to the agitating fluid prior to its introduction to—and mixing with—the working fluid. Thus, the fact that the pump 300 itself is an active device that requires supplemental/external power to operate is irrelevant to (and therefore not destructive of) the passive way that the agitating fluid is captured, mixed and used with the working fluid, as there are no additional external means required to coax the ambient pressure agitating fluid into the working fluid.

Figure 9:
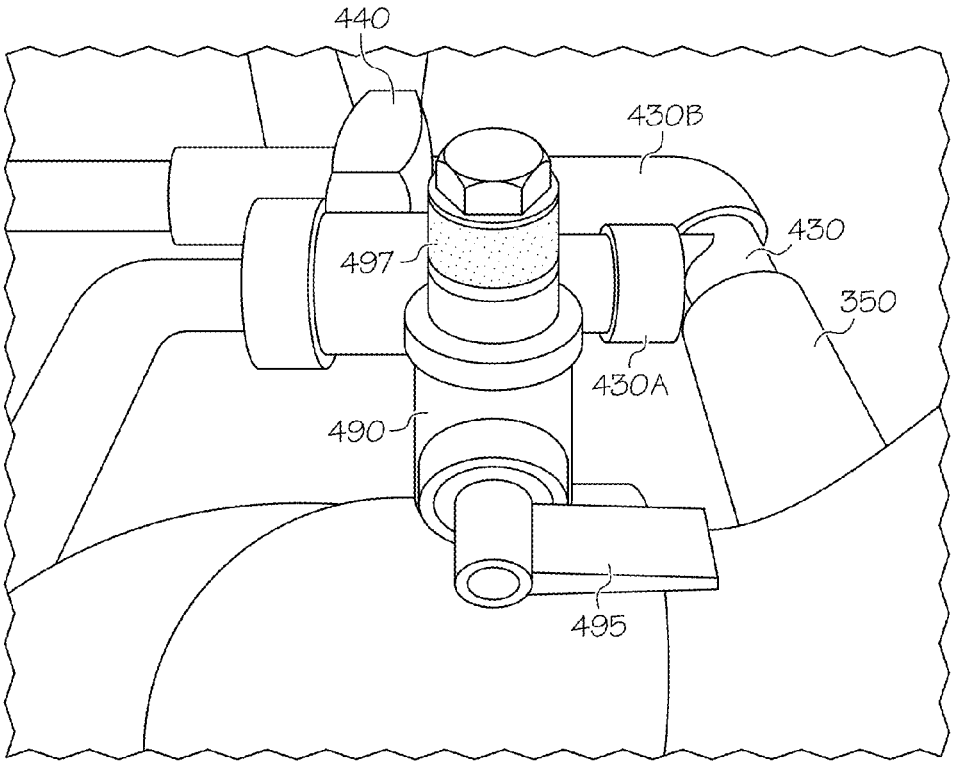
FIG. 9 shows an adjustable speed regulating muffler and ball valve that may be used as part of an open-loop embodiment of the container system.

Referring next to FIG. 9, and although not shown in conjunction with the closed system embodiment of FIGS. 1 through 5, supplemental air may be introduced and mixed in with the recirculating working fluid through an external air access line 490 along with the selective operation of a corresponding valve 495 as a way to convert the closed-loop system into an open-loop variant. Such air may—because it can be metered and regulated—be beneficial in ensuring a pre-set amount of air flow. The valve 495 can be used to fine tune the mixture of air and liquid for the best enhanced surface-mixing effect. A speed-regulating muffler 497 may also be included to offer pre-set amounts of air flow. Thus, while the valve 495 is used to selectively permit the introduction of the augmented mixing agitation fluid, it is the muffler 497 that by virtue of its speed-regulating attributes that permits fine-tuning of the amount of agitation made possible by the introduction of the supplemental air. In one form, the muffler 497 includes an adjustable set screw to meter the amount of air being introduced. As such, the muffler 497 has adjustable speed features that can be preset to admit the proper amount of air for good agitation while not causing loss of priming to the pump 300.

Within the present context, the air or related gas being passed through the fluid recirculating system 400 (as well as the recirculating system 900 that is discussed below) is considered to be recirculated, regardless of whether being introduced as part of the closed-loop assemblies 100, 600 or as part of an open-loop system such as depicted in FIG. 9; the only difference is the size of the air or gas supply or reservoir. For example, in the closed-loop variant, the air is drawn from the interstitial volume at the top of the tank and into the inlet side of the pump from the second flowpath, from there, it is pressurized, routed through the first flowpath and eductor, dispersed into the bulk (i.e., resident) portion of the liquid that has yet to be circulated, after which it is bubbled up to the top of the tank where it can then be drawn into the pump inlet to repeat the cycle. Likewise, the supplemental air that comes from the local external environment goes through the same cycle save the fact that rather than it being part of the relatively small volume that occupies the top of the tank, it is part of a much larger volume that coincides with such environment. Furthermore, it will be appreciated that such environment may be as small as an individual room where the assembly is stored, or could be all of the outdoors in situations where the assembly is not enclosed within a building or other air-limiting enclosure.

In another form, an automated controller (not shown) may be employed to determine when (and to what extent) either the closed-loop air introduction valve 465 or the open-loop valve 495 of FIG. 9 is manipulated; such controlling may be microprocessor-based where a known algorithm, lookup table or other parameter-oriented set of flow, mixing or related conditions are used. Such a controller may also be used to regulate operation of the pump 300. The combination of the enhanced eductor-based agitation, coupled with the air bubble formation made possible by the use of the internal air (in the closed-loop system) or the external air (in the open-loop system) through their respective valves are particularly effective at breaking up the partially encrusted, viscous or serum-like surface layer that may exist when the working fluid has been in prolonged storage or exposed to low-temperature environments. As mentioned above, working fluid that is particularly susceptible to such surface layer formation may include pesticides, fertilizer, broad-spectrum herbicides, paints, dyes, coatings, pigments or related industrial chemicals or the like; by having the lower density air pass through the eductor 450 near the bottom of the tank 200, it can percolate up to the top of the tank 200, causing further agitation to the working fluid contained therein. The bubbling effect is particularly effective at causing enhanced mixing at the top surface level of the fluid. As such, the use of the eductor 450 along with air introduction helps to promote better fluid uniformity through (1) enhanced agitation of the sediment or dense liquid at or near the bottom of the tank 200, (2) increased batch turnover through rolling movement up the tank 200 sidewalls, and (3) air bubble formation for additional mixing action of the less dense liquid at or near the top of the tank 200.

The present inventor has determined that pump 300—by virtue of its diaphragm-based construction—is particularly well-suited for assembly 100 because its structure is resistant to the wear that would occur in many other types of pumps when gas or vapor is introduced upstream of the pump the inlet portion of the pump 300 fluid stream. In particular, because of the additional introduction of air as an agitant into the fluid-recirculating system 400, and further because it is introduced upstream of the pumping chambers, the normal recirculating mode of operation of the pump 300 can be expected to expose the pump internals (including the diaphragm 320, valves 330 and other loaded or exposed components) to such a mixed-state fluid. In fact, the introduction of such air upstream of the pumping chambers of diaphragm pump 300 ensures that a redundant second pump is not needed in order to promote the type of mixing of the working and agitating fluids that is needed for the augmented agitation that is made possible by fluid-recirculating system 400.

Figure 6:
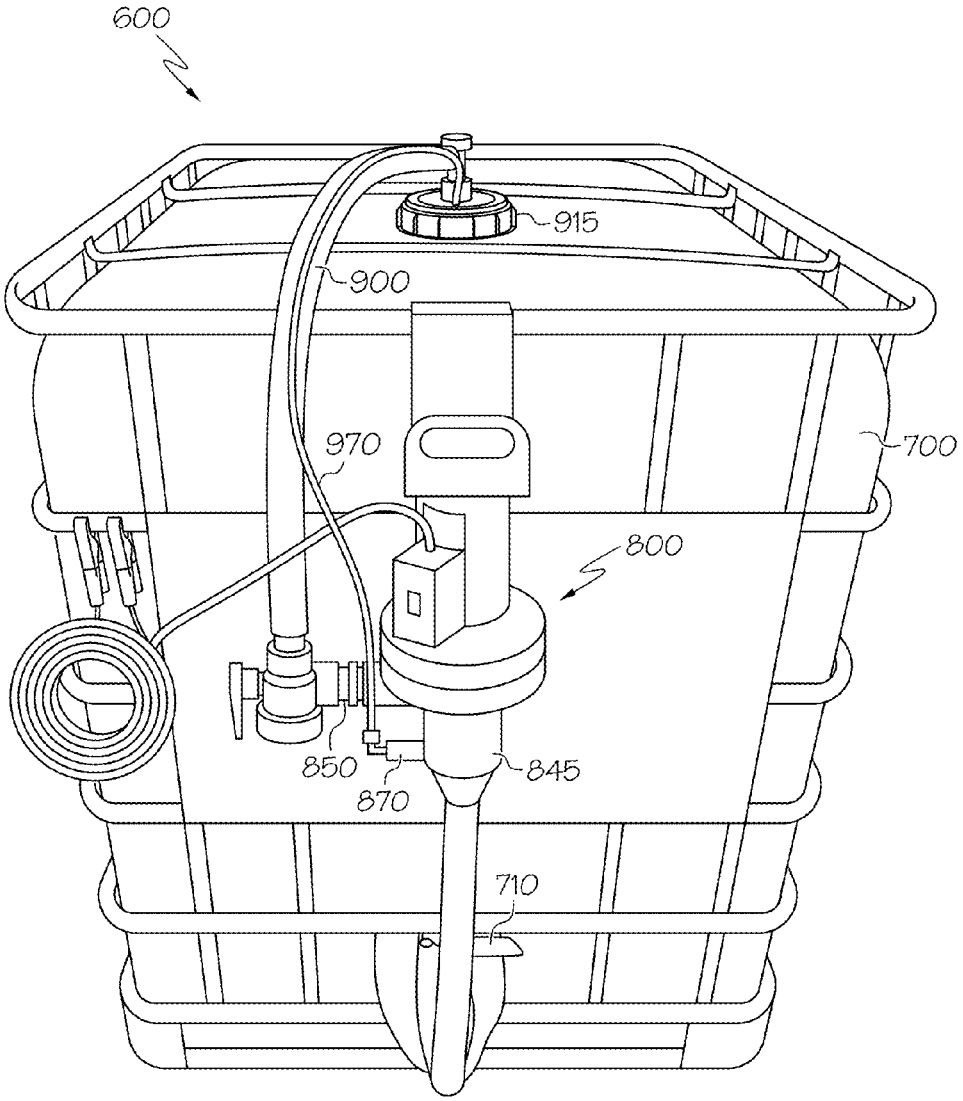
FIG. 6 shows an elevation view of a closed-loop embodiment of the container system that includes an IBC fluid container with a diaphragm pump and fluid-recirculating conduit according to another aspect of the present invention.
Figure 7:
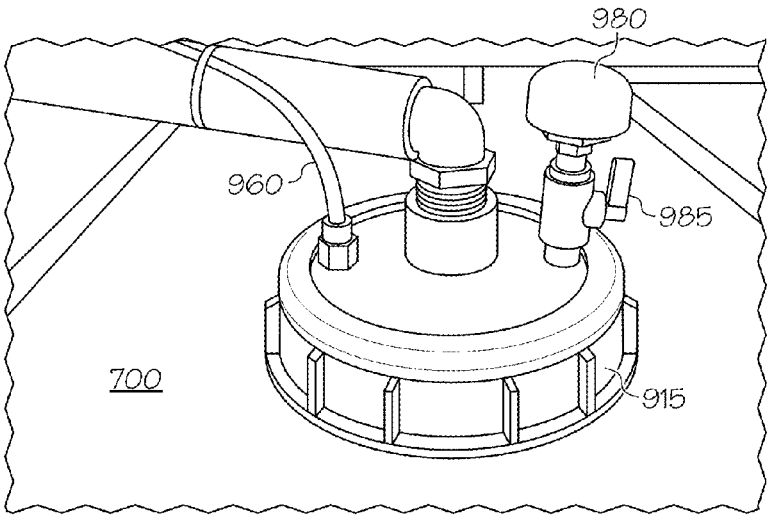
FIG. 7 shows details of the lid and portions of the fluid-recirculating conduit of FIG. 6.
Figure 8:
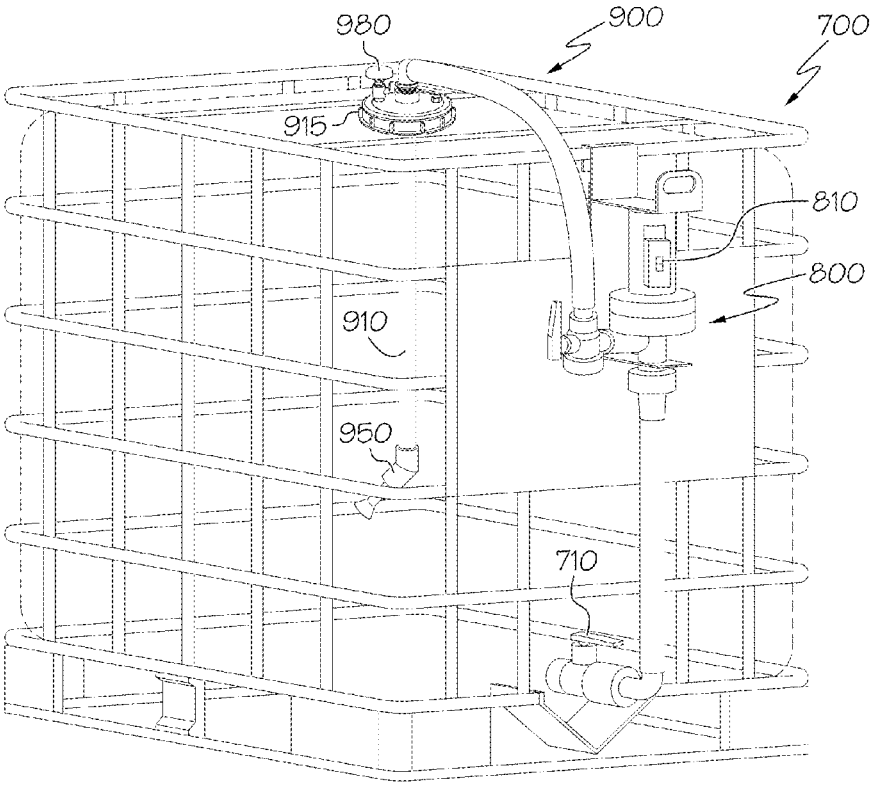
FIG. 8 shows the pump and fluid-recirculating system of FIG. 6 mounted onto a skeleton frame with the container removed for clarity.

Referring with particularity to FIGS. 6 through 8, an assembly 600 made up of an IBC 700 made up of a plastic container or tank and reinforcing rectangular metal cage, pump 800 and fluid-recirculating system 900 according to a second embodiment of the present invention is shown. Pump 800 is in most regards similar in construction to pump 300, and as such the details associated with its construction will not be repeated other than to identify particular components or the most significant difference between the two as it relates to how the discharge (i.e., output) 850 is fluidly coupled a lid 915 that is secured to the top of the IBC 700, and how the input 845 is coupled to the tank bottom.

Figure 4:
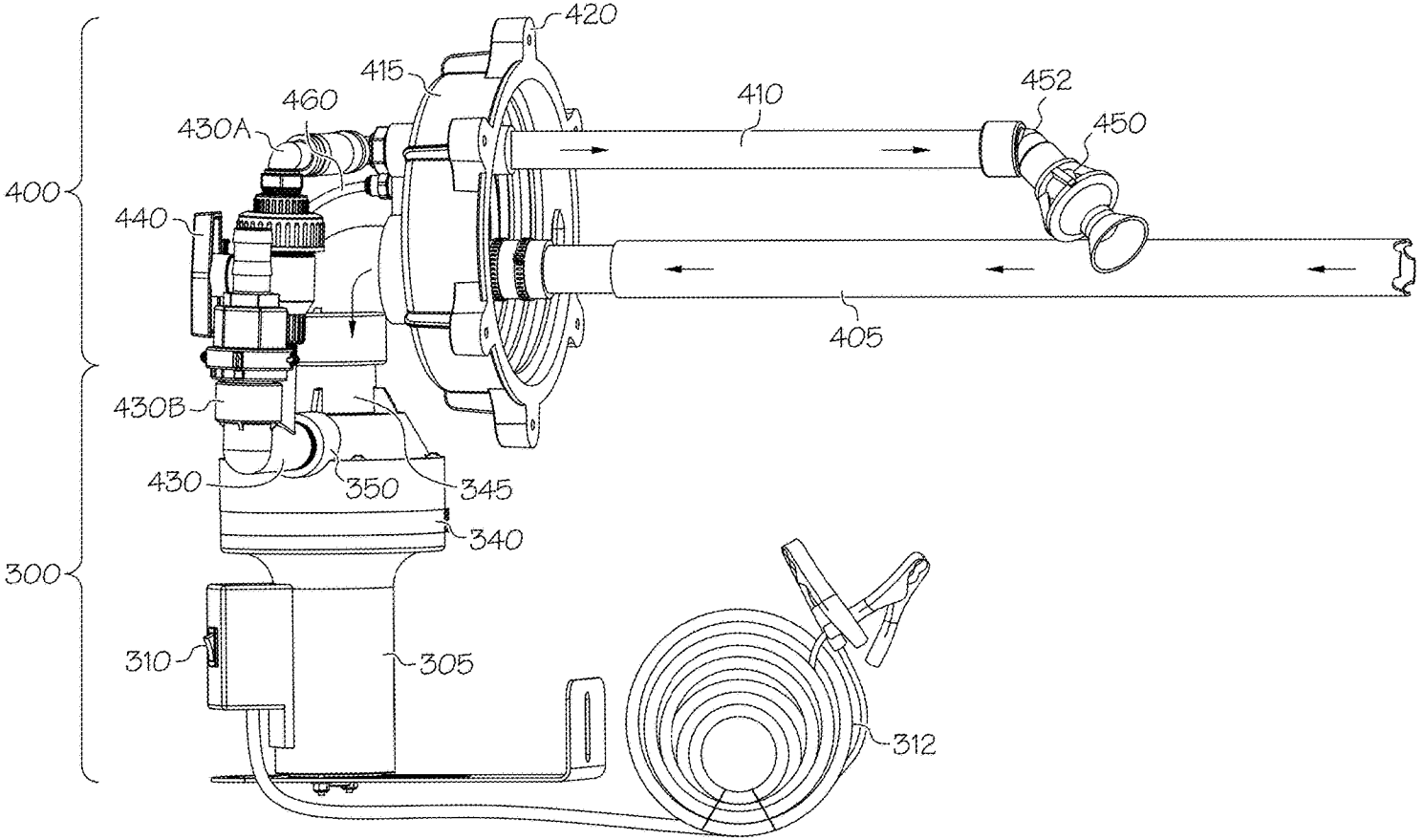
FIG. 4 shows the pump and fluid-recirculating conduit in isolation, including the fluid coupling of the pump to the fluid uptake pipe, eductor and down pipe.

Unlike the tank 200 that is depicted in the first embodiment, the IBC 700 defines a second opening or related access formed at or near the bottom its housing so that liquid contained therein may be drawn to the side-mounted pump 800 and then through the conduit of the fluid-recirculating system 900, including the down pipe and eductor that are similar in construction to the ones depicted in FIG. 4. A valve 710 may also be situated within the conduit that couples this lower portion of the IBC 700 to the pump 800 intake. As such, the IBC 700 version withdraws fluid from the bottom opening in IBC 700. The lid 915 configuration exhibits a hybrid construction that differs from the version depicted in FIG. 5 where the lid 415 is used for both the dip tube 405 and the downpipe 410 with eductor 450. In the hybrid version that is shown with particularity in FIG. 7, the fluid-recirculating system 900 is bifurcated at the lid 915 such that only the output 850 from the pump 800 through piping 930A along with recirculating air 960 is passed through the lid 915 and then onto down pipe 910 and eductor 950. The line used for recirculating air 960 operates in a manner generally similar to that of air line 460 of FIG. 5. In it, air from inside the tank of IBC 700 enters the tubing (which in one non-limiting form may be a ¼" push-to-connect variant) that is mounted to lid 915, and is pulled into the pump 800 through a small valve 870 (shown with particularity in FIG. 7) mounted on the pump inlet 845; valve 870 is typically only used when the tank of IBC 700 is being emptied (to replace the fluid volume with air, so the tank does not collapse). Another valve 880 is placed fluidly downstream of the output 850 and can be used to selectively route pressurized working fluid through a suitable discharge hose and flowmeter (neither of which are shown) for liquid-dispensing purposes. In one form, the lid 915 used in conjunction with IBC 700 is made from a two-piece design where the lid 915 is threadably-engaged with a corresponding threaded mount (not shown) formed around the aperture at the top of the IBC 700. This allows rotation of the threaded portion of the cap 915 without disconnecting the conduit or other hoses that connect the pump 800 to the fluid-recirculating system 900 as a way to enhance the portability of the pump assembly 600.

As discussed above, a bottom-feed fluid access from IBC 700 is fed to the pump inlet 845. An optional venting system including a vent cap 980 and valve 985 may also be formed in the lid 915; such a system may be used only when discharging the fluid from IBC 700 in the manner consistent with the fluid's intended use. Although not shown, such a venting system may also be used with the system 100 of FIGS. 1 through 5.

As with the mini bulk tank 200 version discussed above, the IBC 700 version is preferably a closed system. In that way, the air needed to perform the agitation is taken via fluid-recirculating system 900 from the volume within the IBC 700 that is immediately underneath the lid, rather than from the ambient environment. This is valuable in situations where it is desired to avoid air introduction (such as by induction or the like) to the contained liquid as a way to prevent detrimental reactions between them. Of course, a supplemental air introduction system (not shown) similar to that of FIG. 9 may also be used for the IBC 700-based configuration in situations where the liquid being stored therein is chemically and environmentally compatible with such air.

Significantly, pumps 300, 800 perform dual functions in a manner consistent with the bifurcating parallel paths that make up a portion of the flowpaths of the conduit. Thus, in addition to functioning as a fluid mixer or agitator when in recirculation mode, they can be used to dispense the fluid to a location outside of the respective tanks 200, 700 when needed. As shown with particularity in FIG. 2, the fluid-recirculating system 400 may share some common flowpath portions via sections of piping 430 such that respective recirculation or dispensing of the working fluid through the corresponding bifurcating parallel paths 430A, 430B is dictated by a valve that can be adjusted, depending on the need. Although not shown for the fluid-recirculating system 900 of FIGS. 6 through 8, such bifurcation may also be employed therein.

It is noted that terms like "preferably", "generally" and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. Likewise, for the purposes of describing and defining the present invention, it is noted that the terms "substantially" and "approximately" and their variants are utilized herein to represent the inherent degree of uncertainty that may be attributed to any quantitative comparison, value, measurement or other representation, as well as to represent the degree by which a quantitative representation may vary without resulting in a change in the basic function of the subject matter at issue.

While certain representative embodiments and details have been shown for purposes of illustrating the invention, it will be apparent to those skilled in the art that various changes may be made without departing from the scope of the invention, which is defined in the appended claims.

What is claimed is:

1. A recirculation assembly for enhanced mixing in a liquid container, said assembly comprising:

a diaphragm pump defining an inlet, an outlet and at least one pressurizing device between said inlet and outlet;

a fluid-recirculating system cooperative with said pump and comprising a conduit defining first and second flowpaths wherein said first flowpath includes an eductor fluidly cooperative therewith such that upon operation of said pump and receipt of liquid that is resident within said container into said first flowpath, recirculating liquid passing through said eductor causes an adjacent portion of said resident liquid to be drawn therein to increase output of said recirculating liquid therefrom, and further wherein said second flowpath is fluidly cooperative with said first flowpath such that air withdrawn from a volumetric region within said container is combined with said recirculating liquid such that upon passage of a mixed phase fluid flow comprising both recirculating air and said recirculating liquid through said eductor, said recirculating air forms bubbles that are dispersed within said resident liquid for subsequent upward travel therethrough within said container; and a lid coupled to said pump and said fluid-recirculating system such that when secured to said container, said lid forms at least one of a threadable or bolted tamper-resistant coupling with said container, wherein at least a portion of said pump is secured to said lid.

2. The assembly of claim 1, wherein said fluid-recirculating system further comprises a valve disposed therein to provide selective fluid decoupling between said first flowpath and said second flowpath.

3. The assembly of claim 1, wherein said pump and said fluid-recirculating system define a closed loop when coupled to said container.

4. The assembly of claim 1, wherein said eductor is configured to be placed adjacent a bottom of said container.

5. The assembly of claim 4, wherein said eductor is placed at an acute angle relative to said bottom of said container.

6. The assembly of claim 1, further comprising a supplemental air introduction conduit that is fluidly cooperative with said first flowpath such that ambient external air is selectively combined with said recirculating liquid such that upon passage of both supplemental air and said recirculating liquid through said eductor, said supplemental air forms bubbles that are dispersed within said resident liquid for subsequent upward travel therethrough within said container.

7. A fluid-dispensing assembly comprising:

a container configured to house a fluid therein; and a recirculation assembly for enhanced mixing of a fluid that is resident within said container, said recirculation assembly comprising:

a diaphragm pump defining an inlet, an outlet and at least one pressurizing device between said inlet and outlet; and a fluid-recirculating system cooperative with said pump and comprising a conduit defining first and second flowpaths wherein said first flowpath includes an eductor fluidly cooperative therewith such that upon operation of said pump and receipt of liquid that is resident within said container into said first flowpath, recirculating liquid passing through said eductor causes an adjacent portion of said resident liquid to be drawn therein to increase output of said recirculating liquid therefrom, and further wherein said second flowpath is fluidly cooperative with said first flowpath such that air withdrawn from a volumetric region within said container is combined with said recirculating liquid upstream of said pump inlet such that upon passage of a mixed phase fluid flow comprising both recirculating air and said recirculating liquid through said at least one pressurizing device and said eductor, said recirculating air forms bubbles that are dispersed within said resident liquid for subsequent upward travel therethrough within said container; and a lid coupled to said pump and said fluid-recirculating system such that when secured to said container, said lid forms at least one of a threadable or bolted tamper-resistant coupling with said container, wherein at least a portion of said pump is secured to said lid.

8. The assembly of claim 7, wherein said container is selected from a group consisting of an intermediate bulk container and a mini bulk tank.

9. The assembly of claim 8, wherein said intermediate bulk container defines a fluid capacity of between about 120 and 330 gallons.

10. The assembly of claim 7, wherein said container, fluid-recirculating system and pump define a closed-loop.

11. The assembly of claim 7, further comprising a supplemental air introduction conduit that is fluidly cooperative with said first flowpath such that ambient external air is selectively combined with said recirculating liquid such that upon passage of both supplemental air and said recirculating liquid through said eductor, said supplemental air forms bubbles that are dispersed within said resident liquid for subsequent upward travel therethrough within said container.

12. The assembly of claim 1, wherein at least a portion of said conduit in said recirculating system is secured to said lid.

13. The assembly of claim 7, wherein at least a portion of said conduit in said recirculating system is secured to said lid.

* * * * *